United States Patent [19]

Yokoyama et al.

[11] Patent Number: 4,935,567

[45] Date of Patent: Jun. 19, 1990

[54] PROCESS FOR LIQUEFYING CELLULOSE-CONTAINING BIOMASS

[75] Inventors: Shinya Yokoyama; Tomoko Ogi; Katsuya Koguchi, all of Ibaraki, Japan

[73] Assignee: Agency of Industrial Science and Technology, Japan

[21] Appl. No.: 873,257

[22] Filed: Jun. 6, 1986

Related U.S. Application Data

[63] Continuation of Ser. No. 709,791, Mar. 8, 1985, abandoned.

[30] Foreign Application Priority Data

Nov. 9, 1984 [JP] Japan ..... 59-236174

[51] Int. Cl.[5] ..... C07C 1/00

[52] U.S. Cl. ..... 585/240; 127/37; 585/357; 585/469; 585/638; 585/733

[58] Field of Search ..... 585/240, 357, 469, 638, 585/733; 127/37

[56] References Cited

U.S. PATENT DOCUMENTS 2,177,557 10/1939 Bergstrom ..... 585/240
2,551,579 5/1951 Berl ..... 585/240
4,409,032 10/1983 Paszner et al. ..... 127/37
4,470,851 9/1984 Paszner et al. ..... 127/37
4,520,105 5/1985 Sinner et al. ..... 127/37

FOREIGN PATENT DOCUMENTS 2482145 11/1981 France ..... 127/37

*Primary Examiner*—Asok Pal
*Attorney, Agent, or Firm*—Lorusso & Loud

[57] ABSTRACT

A cellulose-containing biomass such as wood is liquefied by heat-treatment under a pressurized condition in the presence of water and a neutral, oxygen-containing organic liquid such as an ester, ether, ketone or alcohol. An alkaline catalyst such as potassium carbonate may be added to accelerate the liquefaction when the organic liquid is one other than acetone. Also provided is a process for the liquefaction of a cellulose-containing biomass including heat-treating the biomass in an aqueous medium in the pressurized atmosphere of an inert gas or steam at a temperature of 250°-385° C. in the presence of an alkaline catalyst in an amount of 0.01-0.1 part by weight per one part by weight of the biomass on the dry basis.

26 Claims, No Drawings

PROCESS FOR LIQUEFYING CELLULOSE-CONTAINING BIOMASS

This application is a continuation of application Ser. No. 709,791, filed Mar. 8, 1985, now abandoned.

BACKGROUND OF THE INVENTION

This invention relates to a process of converting a cellulose-containing biomass into a liquid useful as fuel or as a raw material for various chemical compounds.

Many studies have thus far been made on liquefaction of cellulose-containing biomass materials such as wood. For example, there is proposed a process in which a biomass is, after being dispersed in a recycled oil or after being hydrolyzed with an acid, heat-treated at a temperature of about 350° C. and a pressure of a reducing gas (such as CO, $H_2$ or a mixture thereof) of about 290 atm. The use of such a reducing gas is, however, disadvantageous from the standpoint of economy and safety. Further, the liquefied product obtained with such a conventional process contains a highly viscous solid mass, the removal of which from the product is quite difficult. Thus, the conventional process is not entirely satisfactory as an industrially applicable process.

SUMMARY OF THE INVENTION

It is, therefore, an object of the present invention to provide an economical process for the liquefaction of a cellulose-containing biomass.

Another object of the present invention is to provide a process which can liquefy a cellulose-containing biomass with a high yield without using a reducing gas such as $H_2$ or CO.

It is a special object of the present invention to provide a process for the liquefaction of a cellulose-containing biomass in which the liquefied product may be easily recovered from the reaction mixture.

It is a further object of the present invention to provide a process by which a liquefied product having a high calorific value, e.g. 7,500–8,000 Kcal/Kg, may be produced from the biomass.

In accomplishing the foregoing objects, there is provided in accordance with the present invention a process for the liquefaction of a cellulose-containing biomass, which comprises heat-treating the biomass under a pressurized condition in the presence of water and a neutral, oxygen-containing organic liquid.

The present invention also provides a process for the liquefaction of a cellulose-containing biomass, which comprises heat-treating the biomass in an aqueous medium in the pressurized atmosphere of an inert gas or steam at a temperature of 250°–385° C. in the presence of an alkaline catalyst in an amount of 0.01–0.1 part by weight per one part by weight of the biomass on the dry basis.

Other objects, features and advantages of the present invention will become apparent from the detailed description of the invention to follow.

DETAILED DESCRIPTION OF THE INVENTION

In accordance with one embodiment of the present invention, the cellulose-containing biomass is heat-treated in the presence of water and a neutral, oxygen-containing organic liquid so that the biomass is decomposed or hydrolyzed to give a liquefied product. The term "cellulose-containing biomass" used in the present specification is intended to refer to various kinds of materials containing cellulose. Examples of the cellulose-containing biomass include wood, wood chips, wood powder, bark, bagasse, bamboo, papers, peat and cellulose-containing waste materials (e.g. sewage, soil, city wastes and the like). The content of the cellulose in the biomass to be treated is not specifically limited, though a high cellulose content is more preferred. Preferably, the content of the cellulose in the biomass is at least 10 wt %, more preferably at least 50 wt % on dry basis. It is also preferred that the biomass to be treated be finely divided.

The term "neutral, oxygen-containing organic liquid" used in the present specification is intended to mean an organic liquid which has no acidic or basic functional group such as a carboxylic or amino group. Examples of suitable oxygen-containing organic liquid include alcohols such as methanol, ethanol, propanol, buthanol and ethylene glycol, ketones such as methyl ethyl ketone, ethers such as dioxane and tetrahydrofuran, and esters such as methyl acetate and ethyl acetate.

The oxygen-containing organic liquid serves to accelerate the reactions resulting in the liquefaction of the biomass and makes it easy to separate the liquefied product from the reaction mixture. After liquefaction, the organic liquid may be recovered, if desired, for reuse.

The amount of the oxygen-containing organic liquid used is generally in the range of 1–99 wt %, preferably 5–80 wt % based on the total weight of the oxygen-containing organic liquid and water. The total amount of the oxygen-containing organic liquid and water is generally in the range of 2–80 parts by weight, preferably 5–20 parts by weight per part by weight of the cellulose-containing biomass (on dry basis).

The liquefaction is performed under an inert gas pressure or steam pressure or preferably 3–100 atm, more preferably 5–40 atm in terms of the initial pressure (a pressure at the commencement of the liquefaction treatment). The reaction temperature is generally in the range of 200°–400° C., preferably in the range of 250°–350° C. The reaction may be carried out while heating the reaction mixture continuously or incrementally at a heat-up rate of 2°–300° C. per min.

The term "inert gas" used in the present specification is intended to refer to any gas which is substantially inert under the condition of the liquefaction treatment. Illustrative of suitable inert gases are nitrogen, carbon dioxide and a rare gas such as argon. It is to be noted, however, that the inert gas can be partly or entirely replaced by steam in the process of the present invention.

In order to accelerate the liquefaction, it is generally preferred that the heat treatment of the biomass be performed in the presence of an alkaline substance serving as a catalyst, especially when the oxygen-containing organic liquid employed is not acetone. In the case of acetone, it has been found that the presence of the alkaline catalyt does not contribute to the acceleration of the liquefaction. Illustrative of suitable alkaline substances are sodium hydroxide, potassium hydroxide, sodium carbonate, potassium carbonate, sodium hydrogencarbonate, potassium hydrogencarbonate, calcium oxide, calcium hydroxide, sodium formate and potassium formate. The alkaline catalyst may be used in an amount so that the reaction mixture has a pH of 10–14, preferably 11–13. Generally the amount of the alkaline catalyst used is 0.001–0.5 parts by weight, preferably 0.005–0.3 parts by weight, more preferably 0.01–0.1 part by weight per part by weight of the cellulose-containing biomass. (The weight of the biomass is on the dry basis.)

In another embodiment according to the present invention, the biomass is heat-treated in an aqueous medium in the pressurized atmosphere of an inert gas or steam at a temperature of 250°–385° C. in the presence of a specific amount of an alkaline catalyst. The terms "inert gas" and "alkaline catalyst" herein have the same meaning as given hereinabove with respect to the first embodiment. The reaction pressure in this second embodiment is also the same as in the first one. The amount of the alkaline catalyst employed should be 0.01–0.1 part by weight per part by weight of the biomass to be treated (dry basis) in order to obtain the liquefied product with a good yield.

In this second embodiment, when the heat-treatment is carried out at a temperature of 360°–385° C., especially 372°–378° C., the resulting liquefied product recovered from the reaction mixture remains fluent and never solidifies even if it is allowed to stand at room temperature for a long period of time. Such a property of the liquefied product is advantageous in handling and transportation.

The following examples will further illustrate the present invention.

EXAMPLE 1

Dried powder of Japanese oak (5.0 g, 100 mesh or finer) was placed in an autoclave, to which were added 15 ml of acetone, 15 ml of water and 0.5 g of potassium carbonate. Argon gas was then charged into the autoclave until the pressure within the autoclave became 20 atm (initial pressure). The mixture within the autoclave was heated at a heat-up rate of 10° C./min. As soon as the temperature within the autoclave reached 300° C., the contents therein were rapidly cooled to room temperature. The resulting reaction mixture was found to separate into a lower, organic phase and an upper aqueous phase, thus permitting the recovery of the organic phase with ease by recovery means such as decantation, for example. For the purpose of precisely analyzing the yield of the liquefied product, all the contents in the autoclave were filtered and the recovered solid phase was washed well with acetone. The filtrate containing substantially all of the liquid phase obtained by the heat-treatment of the wood powder was then heated at 35° C. under a reduced pressure to distill off the water and low boiling point components to leave 1.65 g of oily, liquefied product.

EXAMPLE 2

Example 1 was repeated in the same manner as described except that no alkaline catalyst (potassium carbonate) was used. After the heat-treatment the reaction mixture was found to separate into aqueous and organic layers as in in Example 1. The yield of the liquefied product was 2.99 g.

EXAMPLE 3

Example 1 was repeated in the same manner as described except that acetone and water were used in amounts of 5 ml and 25 ml, respectively. After the heat-treatment, the reaction mixture was again easily separable, as in Example 1. The yield of the liquefied product was 1.70 g.

EXAMPLES 4, 5 and 6

Example 3 was repeated in the same manner as described except that acetone was replaced with methyl ethyl ketone (example 4), ethyl acetate (Example 5) and n-butanol (Example 6), yielding 1.99 g (Example 4), 3.42 g (Example 5) and 1.66 g (Example 6) of liquefied products. The ease of separation of liquefied product from the reaction mixture was excellent in the case of Examples 4 and 5 and good (comparable to that in Examples 1 through 3) in the case of Example 6. The liquefied products obtained in Examples 1 through 6 were found to have a calorific value of more than 7,500 Kcal/Kg.

EXAMPLE 7

Dried powder of Japanese oak (5.0 g, 80–100 mesh) was placed in an autoclave, to which was added 30 ml of water and 0.5 g of potassium carbonate. Argon gas was then charged into the autoclave so that the pressure within rose to 20 atm. The mixture within the autoclave was heated at a heat-up rate of 10° C./min. The reaction was terminated by rapid cooling when the temperature within the autoclave reached 300° C. The cooled reaction mixture was mixed with acetone, followed by filtration to remove the solid matter contained therein. The inside wall of the autoclave was rinsed well and the solid matter were rinsed with acetone for the complete recovery of the liquid phase. The filtrate thus collected was heated at 35° C. under a reduced pressure to distill off the water and low boiling point components, to leave 2.19 g of a liquefied product.

EXAMPLES 8 and 9

Example 7 was repeated in the same manner as described except that the amount of potassium carbonate used was changed to 0.3 g (Example 8) and 0.2 g (Example 9). The yield of the thus obtained liquefied product was 2.32 g in the case of Example 8 and 2.38 g in the case of Example 9.

EXAMPLES 10, 11 and 12

Dried powder of Japanese oak (5.0 g, 80 mesh or finer) was treated in the same manner as described in Example 7 except that the reaction mixture was heated to 350° C. (Example 10), 375° C. (Example 11) and 400° C. (Example 12). The yields of the liquefied products in Examples 10 through 12 were 1.31 g, 1.0 g and 0.75 g, respectively. The liquefied product obtained in Example 11 did not solidify when allowed to stand for a long period of time (2,000 hours or more), while those in Examples 10 and 12 (Examples 7–9 as well) solidified.

EXAMPLE 13

Dried powder of Japanese oak (5.0 g, 80 mesh or finer) was liquefied in the same manner as that in Example 7 with the exceptions that potassium carbonate was used in an amount of 1.0 g and that the reaction was allowed to continue for 30 minutes after the reaction temperature reached 300° C. The yield of the liquefied product was 1.42 g.

EXAMPLES 14 and 15

Example 13 was repeated in the same manner as described except that the reaction mixture was heated to 350° C. (Example 14) and to 375° C. (Example 15) and maintained at that temperature for 30 minutes before being rapidly cooled. The yield of the liquefied product was 1.23 in the case of Example 14 and 1.17 g in the case of Example 15. The liquefied product obtained in Example 15 did not solidify when allowed to stand at room temperature for 2,000 hours or more. In contrast, the products in Examples 13 and 14 solidified. The results of elementary analysis, the recovery rate of carbon and hydrogen (CHR= (total weight of H and C of the liquefied product)×100/(total weight of H and C of starting wood powder (%)) and calorific value of the liquefied product in each of Examples 7 through 15 are summarized in Table below.

| Example | CHR (%) | Elementary analysis (wt %) C | H | O | Calorific value (Kcal/Kg) |
|---|---|---|---|---|---|
| 7 | 58.7 | 63.85 | 6.43 | 29.72 | 6,120 |
| 8 | 61.0 | 62.84 | 6.12 | 31.04 | 5,860 |
| 9 | 62.0 | 62.06 | 6.33 | 31.61 | 5,840 |
| 10 | 26.3 | 75.56 | 7.48 | 15.19 | 8,080 |
| 11 | 34.5 | 73.53 | 7.79 | 18.68 | 7,820 |
| 12 | 24.4 | 77.89 | 8.11 | 14.00 | 8,490 |
| 13 | 41.5 | 69.34 | 6.86 | 23.80 | 6,950 |
| 14 | 37.0 | 71.63 | 6.90 | 21.47 | 7,250 |
| 15 | 34.9 | 68.52 | 9.39 | 22.09 | 7,820 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to embraced therein.

We claim:

1. A process for the liquefaction of a cellulose-containing biomass to produce a liquefied product, said process comprising:

(a) feeding to a reaction vessel the biomass, water and a neutral oxygen-containing organic liquid to provide an admixture in said vessel consisting essentially of said biomass, said organic liquid and water, the total of the oxygen-containing organic liquid and water in said admixture being 5–20 parts by weight per part by weight of the biomass on the dry basis and the amount of oxygen-containing organic liquid in said admixture being 5–80% of the total of said liquid and water;

(b) heating said admixture within said vessel to 200°–400° C. at 3–100 atm pressure to produce, within said vessel, a liquefied product in the form of an oily liquid phase coexistent with a separate aqueous phase;

(c) separating said oily liquid phase from said aqueous phase and recovering said separated oily liquid phase as a liquefied product; and (d) heating said separated oily liquid phase to distill off low boiling components and recovering a liquefied product of increased calorific value as the distillation residue.

2. A process as claimed in 1, wherein the neutral, oxygen-containing organic liquid is selected from the group consisting of alcohols, esters, ethers, ketones and mixtures thereof.

3. A process as claimed in claim 2, wherein the neutral, oxygen-containing organic liquid is selected from the group consisting of methyl acetate, ethyl acetate, methyl ethyl ketone, buthanol, propanol, acetone and mixtures thereof.

4. A process as claimed in claim 3, wherein the neutral, oxygen-containing organic liquid is acetone.

5. A process as claimed in claim 1, wherein the heat-treatment is performed in the presence of an inert gas or steam.

6. A process as claimed in claim 5, wherein the inert gas is nitrogen gas, carbon dioxide gas or rare gas.

7. A process in accordance with claim 1 wherein the liquefied product of step b is cooled to approximately room temperature prior to step c and the separating of step c is by decanting.

8. A process in accordance with claim 1 wherein said heating is at 250°–350° C. at a pressure of 5–40 atms.

9. A process in accordance with claim 1 wherein said biomass contains at least 10 wt % cellulose, dry basis.

10. A process in accordance with claim 1 wherein said biomass contains at least 50 wt % cellulose, dry basis.

11. A process for the liquefaction of a solid cellulose-containing biomass to produce a liquefied product of high calorific value, said process comprising:

(a) admixing water, 1 part by weight, dry basis, of the biomass and 0.01–0.1 parts by weight of an alkaline catalyst;

(b) heating said admixture at a temperature of 250°–385° C. in an atmosphere of an inert gas or steam and at an elevated pressure to produce a reaction mixture;

(c) cooling said reaction mixture to terminate the reaction;

(d) mixing the cooled reaction mixture with a liquid organic extractant;

(e) separating solids from the admixture formed in (d) to obtain a liquid phase; and (f) heating said liquid phase under reduced pressure to distill off the water and low boiling components and recovering the residue as said liquefied product of high caloric value.

12. A process as claimed in claim 11, wherein the alkaline catalyst is selected from the group consisting of sodium hydroxide, potassium hydroxide, sodium carbonate, potassium carbonate, sodium hydrogencarbonate, potassium hydrogencarbonate, calcium oxide, calcium hydroxide, sodium formate, potassium formate and mixtures thereof.

13. A process as calimed in claim 11, wherein the inert gas is nitrogen gas, carbon dioxide gas or rare gas.

14. A process as claimed in claim 11, wherein the aqueous medium is used in an amount of 2–80 parts by weight per one part by weight of the biomass on the dry basis.

15. A process as claimed in claim 11, wherein the heat-treatment is performed at a temperature of 360°–385° C.

16. A process in accordance with claim 11 wherein said temperature is 372°–378° C.

17. A process in accordance with claim 11 wherein said elevated pressure is 3–100 atm.

18. A process in accordance with claim 11 wherein said biomass contains at least 10 wt % cellulose, dry basis.

19. A process in accordance with claim 11 wherein said biomass contains at least 50 wt % cellulose, dry basis.

20. A process for the liquefaction of a cellulose-containing biomass to produce a liquefied product, said process comprising:

(a) feeding to a reaction vessel the biomass, water, an alkaline catalyst and a neutral oxygen-containing organic liquid to provide an admixture in said vessel consisting essentially of said biomass, said organic liquid, said alkaline catalyst and said water, the total of the oxygen-containing organic liquid and water in said admixture being 5–20 parts by weight per part by weight of the biomass on the dry basis and the amount of oxygen-containing organic liquid in said admixture being 5–80% of the total of said liquid and water;

(b) heating said admixture within said vessel to 200°–400° C. at 3–100 atm pressure to produce, within said vessel, a liquefied product in the form of an oily liquid phase coexistent with a separate aqueous phase; and (c) separating said oily liquid phase from said aqueous phase and recovering said separated oily liquid phase as a liquefied product; and (d) heating said separated oily liquid phase to distill off low boiling components and recovering a liquefied product of increased calorific value as the distillation residue.

21. A process as claimed in claim 20, wherein the neutral, oxygen-containing liquid is methyl acetate, ethyl acetate, methyl ethyl ketone, butanol or propanol.

22. A process as claimed in claim 21, wherein the heat-treatment is performed while maintaining the reaction mixture at a pH of 10–14.

23. A process as claimed in claim 22, wherein the alkaline catalyst is selected from the group consisting of sodium hydroxide, potassium hydroxide, sodium carbonate, potassium carbonate, sodium hydrogencarbonate, potassium hydrogencarbonate, calcium oxide, calcium hydroxide, sodium formate, potassium formate and mixtures thereof.

24. A process in accordance with claim 20 wherein said heating is at 250°–350° C. at a pressure of 5–40 atm.

25. A process in accordance with claim 20 wherein said biomass contains at least 10 wt % cellulose, dry basis.

26. A process in accordance with claim 20 wherein said biomass contains at least 50 wt % cellulose, dry basis.

* * * * *